US008893605B1

(12) United States Patent
Hester, Jr. et al.

(10) Patent No.: US 8,893,605 B1
(45) Date of Patent: Nov. 25, 2014

(54) ATTACHABLE/DETACHABLE SEGMENTED ORDNANCE DISPENSER

(75) Inventors: William Clayton Hester, Jr., Allen, TX (US); Deon Austin Harkey, McKinney, TX (US); William J. Gray, III, Lewisville, TX (US); Lea Cozort, O'Fallon, MO (US)

(73) Assignee: The Boeing Company, Chicago, IL (US)

( * ) Notice: Subject to any disclaimer, the term of this patent is extended or adjusted under 35 U.S.C. 154(b) by 277 days.

(21) Appl. No.: 13/448,416

(22) Filed: Apr. 17, 2012

(51) Int. Cl.
*B64D 1/04* (2006.01)

(52) U.S. Cl.
USPC ..... 89/1.51; 89/1.815; 89/37.16; 89/37.01; 244/137.4

(58) Field of Classification Search
USPC ..... 89/1.51, 1.815, 37.16, 1.11, 37.01; 244/137.4
See application file for complete search history.

(56) References Cited

U.S. PATENT DOCUMENTS

| | | | | |
|---|---|---|---|---|
| 8,205,536 | B2 * | 6/2012 | Fisher | 89/1.11 |
| 2010/0258672 | A1 * | 10/2010 | Grabmeier et al. | 244/118.2 |
| 2012/0060672 | A1 * | 3/2012 | Grigg | 89/1.8 |
| 2013/0221158 | A1 * | 8/2013 | Binkholder et al. | 244/137.4 |

* cited by examiner

*Primary Examiner* — J. Woodrow Eldred
(74) *Attorney, Agent, or Firm* — Ameh IP; Elahe Toosi; Lowell Campbell

(57) ABSTRACT

Attachable/detachable segmented ordnance dispenser systems and methods are presented. A control module targets, fuses, and releases ordnance, and at least one ordnance dispenser segment comprises a rack mount ordnance assembly and a segment enclosure. The rack mount ordnance assembly mounts and releases ordnance under control of the control module, and the segment enclosure comprises a segment door that opens under control of the control module. An aerodynamic shell aerodynamically enhances and protects the ordnance dispenser segment and the control module, and can be coupled to a vehicle.

20 Claims, 4 Drawing Sheets

ATTACHABLE/DETACHABLE SEGMENTED ORDNANCE DISPENSER

FIELD

Embodiments of the present disclosure relate generally to ordnance delivery. More particularly, embodiments of the present disclosure relate to ordnance delivery dispensers.

BACKGROUND

Armed unmanned aerial vehicles (UAVs) currently in service carry a low number of missiles, and are not generally used in a Close Air Support (CAS) role.

SUMMARY

Detachable/attachable segmented ordnance dispenser systems and methods are presented. A control module targets, fuses, and releases ordnance, and at least one ordnance dispenser segment comprises a rack mount ordnance assembly and a segment enclosure. The rack mount ordnance assembly mounts and releases ordnance under control of the control module, and the segment enclosure comprises a segment door that opens under control of the control module. An aerodynamic shell aerodynamically enhances and protects the ordnance dispenser segment and the control module, and can couple to a vehicle.

In this manner, an attachable/detachable ordnance dispenser pod is provided to be a force multiplier for small units, Special Operations Command (SOCOM), and naval forces.

In an embodiment, an attachable/detachable segmented ordnance dispenser system comprises: a control module, at least one ordnance dispenser segment, and an aerodynamic shell. The control module targets, fuses, and releases ordnance. The ordnance dispenser segment comprises a rack mount ordnance assembly and a segment enclosure. The rack mount ordnance assembly mounts and releases the ordnance under control of the control module, and the segment enclosure comprising a door that opens under control of the control module. The aerodynamic shell couples to and aerodynamically enhances and protects the ordnance dispenser segment and the control module, and is operable to be coupled to a vehicle.

In another embodiment, an attachable/detachable segmented ordnance dispenser system comprises an ordnance dispenser pod, a rack mount ordnance assembly, a target acquisition sensor, a target designator, a ballistic computer comprising hardware and/or software, a communication module, and an ordnance release mechanism. The ordnance dispenser pod dispenses ordnance, and the rack mount ordnance assembly is coupled to an interior of the ordnance dispenser pod and holds the ordnance. The target acquisition sensor is coupled to the rack mount ordnance assembly and senses a sensed target, and the target designator is coupled to the target acquisition sensor and is operable to designate the sensed target. The ballistic computer is coupled to the target designator and computes an ordnance release timing for each of the ordnance according to the sensed target. The communication module is coupled the ballistic computer and receives the ordnance release timing therefrom. The ordnance release mechanism receives the ordnance release timing from the communication module and releases the ordnance according to and based on the ordnance release timing.

In a further embodiment, a method for providing an attachable/detachable segmented ordnance dispenser system provides an electronic section segment that targets, fuses, and releases ordnance. The method further provides at least one ordnance dispenser segment by providing a rack mount ordnance assembly that mounts and releases ordnance under control of the electronic section segment, and provides a segment enclosure comprising a segment door that opens under control of the electronic section segment. The method further couples an aerodynamic shell to the ordnance dispenser segment and the electronic section segment.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF DRAWINGS

A more complete understanding of embodiments of the present disclosure may be derived by referring to the detailed description and claims when considered in conjunction with the following figures, wherein like reference numbers refer to similar elements throughout the figures. The figures are provided to facilitate understanding of the disclosure without limiting the breadth, scope, scale, or applicability of the disclosure. The drawings are not necessarily made to scale.

DETAILED DESCRIPTION

The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. The present disclosure should be accorded scope consistent with the claims, and not limited to the examples described and shown herein.

Embodiments of the disclosure may be described herein in terms of functional and/or logical block components and various processing steps. It should be appreciated that such block components may be realized by any number of hardware, software, and/or firmware components configured to perform the specified functions. For the sake of brevity, conventional techniques and components related to ordnance, ordnance dispensing, control systems, data transmission, signaling, network control, and other functional aspects of the systems (and the individual operating components of the systems) may not be described in detail herein. In addition, those skilled in the art will appreciate that embodiments of the present disclosure may be practiced in conjunction with a variety of hardware and software, and that the embodiments described herein are merely example embodiments of the disclosure.

Embodiments of the disclosure are described herein in the context of a practical non-limiting application, namely, mortar air drop from an aircraft. Embodiments of the disclosure, however, are not limited to such mortar air drop from aircraft applications, and the techniques described herein may also be utilized in other applications. For example but without limitation, embodiments may be applicable to manned and unmanned ground, air, space, water and underwater vehicles, or other vehicle having a lift capability for dropping ordnance.

As would be apparent to one of ordinary skill in the art after reading this description, the following are examples and embodiments of the disclosure and are not limited to operating in accordance with these examples. Other embodiments may be utilized and structural changes may be made without departing from the scope of the exemplary embodiments of the present disclosure.

Figure 1:
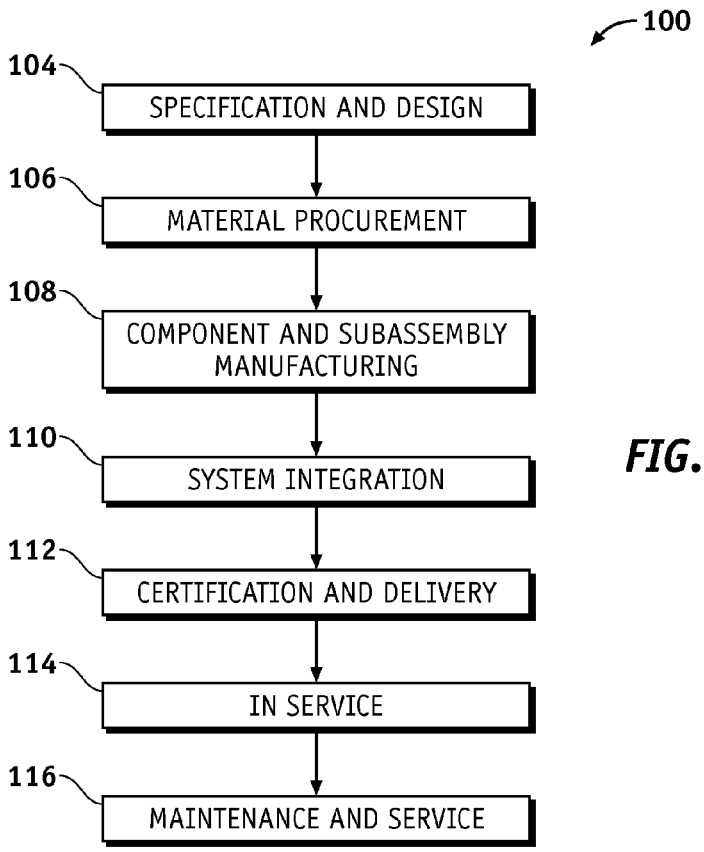
FIG. 1 is an illustration of a flow diagram of an exemplary aircraft production and service methodology.
Figure 2:
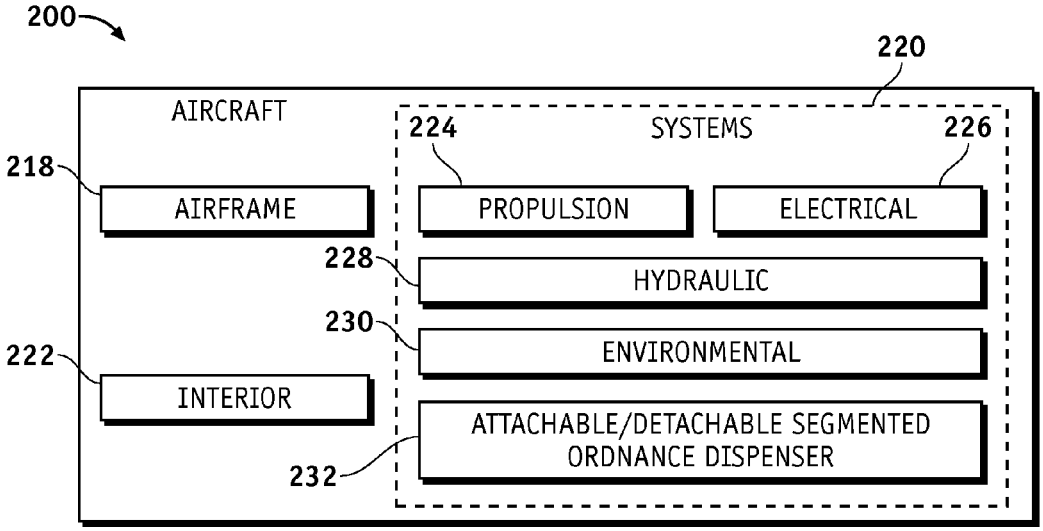
FIG. 2 is an illustration of an exemplary block diagram of an aircraft.

Referring more particularly to the drawings, embodiments of the disclosure may be described in the context of an aircraft manufacturing and service method 100 (method 100) as shown in FIG. 1 and an aircraft 200 as shown in FIG. 2. During pre-production, the exemplary method 100 may include specification and design 104 of the aircraft 200 and material procurement 106. During production, component and subassembly manufacturing 108 and system integration 110 of the aircraft 200 takes place. Thereafter, the aircraft 200 may go through certification and delivery 112 in order to be placed in service 114. While in service by a customer, the aircraft 200 is scheduled for routine maintenance and service 116 (which may also include modification, reconfiguration, refurbishment, and so on).

Each of the processes of method 100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be without limitation an airline, leasing company, military entity, service organization, and the like.

As shown in FIG. 2, the aircraft 200 produced by the exemplary method 100 may include an airframe 218 with a plurality of systems 220 and an interior 222. Examples of high-level systems 220 include one or more of a propulsion system 224, an electrical system 226, a hydraulic system 228, an environmental system 230, and an attachable/detachable segmented ordnance dispenser 232. Any number of other systems may also be included. Although an aerospace example is shown, the embodiments of the disclosure may be applied to other industries.

Apparatus and methods embodied herein may be employed during any one or more of the stages of the production and service method 100. For example, components or subassemblies corresponding to production process 108 may be fabricated or manufactured in a manner similar to components or subassemblies produced while the aircraft 200 is in service. In addition, one or more apparatus embodiments, method embodiments, or a combination thereof may be utilized during the production stages 108 and 110, for example, by substantially expediting assembly of or reducing the cost of an aircraft 200. Similarly, one or more of apparatus embodiments, method embodiments, or a combination thereof may be utilized while the aircraft 200 is in service, for example and without limitation, to maintenance and service 116.

Embodiments of the disclosure provide an attachable/detachable segmented ordnance dispenser pod capable of carrying ordnance such as air dropped mortars to be fitted with aircraft having an endurance and lift capability for dropping mortars.

The endurance and lift capability of some aircraft allow them to be fitted with an attachable/detachable segmented ordnance dispenser pod for carrying many of air dropped mortars. In this manner, these aircraft can provide precision CAS to small units. Because of the endurance, dash speed and quietness these aircraft remain close to covert forces that may require CAS without giving away their location. These aircraft can provide persistent and precision fire in support of naval forces engaged by small boat "swarming" attacks. This type of attack is designed to overwhelm defensive systems of smaller surface ships. Because these mortars can be configured for airburst they would be particularly effective against small boats.

Some Global positioning system (GPS) guided mortars have a circular error probability (CEP) of 5 meters, laser guided mortars have a CEP of 1 meter. Additionally, an 81 mm mortar has low collateral dispersion. Other armed UAVs have a very small number of weapons and are unable to provide sustained fire. The attachable/detachable segmented ordnance dispenser pod according to an embodiment of the disclosure provides a means to overcome these deficiencies.

Figure 3:
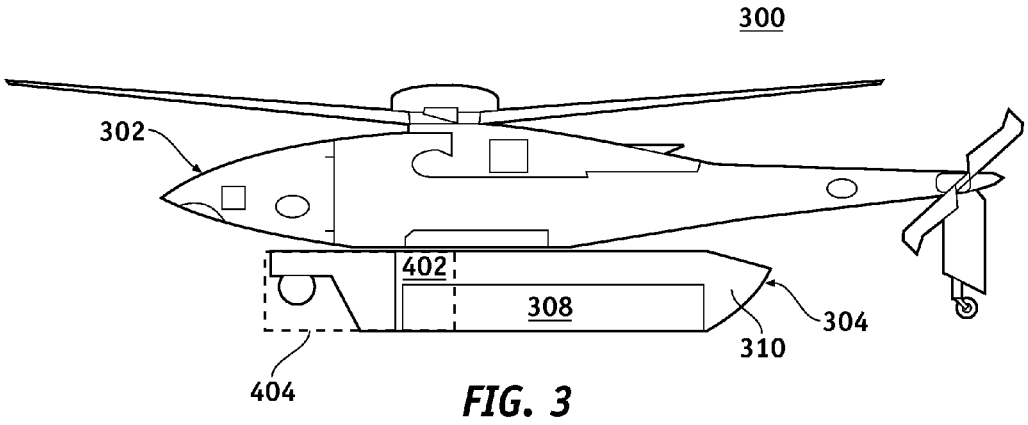
FIG. 3 is an illustration of an aircraft showing an exemplary attachable/detachable ordnance dispenser pod attached thereto according to an embodiment of the disclosure.

FIG. 3 is an illustration of an aircraft 302 (helicopter 302) showing an exemplary attachable/detachable segmented ordnance dispenser pod 304 (ordnance dispenser pod 304) attached thereto according to an embodiment of the disclosure. The ordnance dispenser pod 304 may be a roll on/roll off pod comprising an ordnance bay door 308, a control module 404 and at least one ordnance dispenser pod segment 402 (ordnance dispenser segment 402) as discussed in the context of discussion of FIG. 4 below. The ordnance dispenser pod 304 may also comprise an aerodynamic shell 310 to aerodynamically enhance and protect the control module 404 and the ordnance dispenser pod segment 402, and further coupled to the helicopter 302.

In the embodiment shown in FIG. 3, a helicopter is shown. It will be readily apparent to those of ordinary skill in the art, that the embodiment shown in FIG. 3 can have application or be adapted to other vehicles such as, but without limitation, manned and unmanned ground, air, space, water and underwater vehicles, or other vehicle capable of having a lift capability for dropping ordnance such as mortars.

Figure 4:
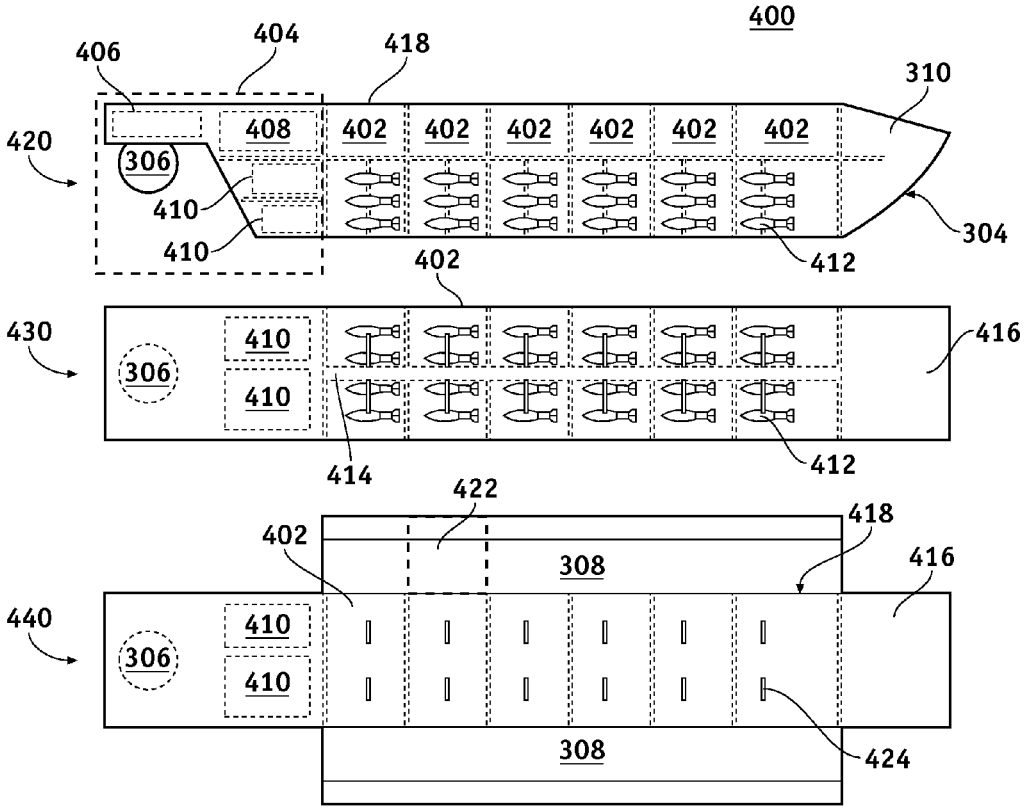
FIG. 4 is an illustration of an exemplary side view, top view, and bottom view of the attachable/detachable segmented ordnance dispenser pod of FIG. 3.

FIG. 4 is an illustration of an exemplary side view 420, top view 430, and bottom view 440 of the attachable/detachable segmented ordnance dispenser pod 304 of FIG. 3. In the embodiment shown in FIG. 4, the ordnance dispenser pod 304 comprises at least one ordnance dispenser segment 402, an electronic section segment 404 (control module 404) coupled to the ordnance dispenser segment 402 and the aerodynamic shell 310.

The ordnance dispenser segment 402 may comprise a rack mount ordnance assembly 414 and a segment enclosure 418 comprising a segment door 422.

The rack mount ordnance assembly 414 is coupled to an interior of the ordnance dispenser pod 304 and comprises selectable pod attachment point location rails 424 atop the ordnance dispenser pod 304, providing an ability to establish a neutral balance. The rack mount ordnance assembly 414 holds/mounts the ordnance 412 and releases the ordnance 412 under control of the control module 404. The ordnance 412 may comprise, for example but without limitation, mortars, bombs, missiles, rockets, gun ammunition, or other air-to-air, anti-ship and anti-submarine weapons.

The ordnance dispenser segment 402 is configured to drop the ordnance 412 using an ordnance release mechanism 532 (FIG. 5) as explained below. For example but without limitation, the ordnance dispenser segment 402 can drop an 81 mm (e.g., Laser/GPS) guided mortar (e.g., 10 lb. class), a 120 mm (e.g., Laser/GPS) guided mortar (e.g., 35 lb. class), a combination thereof, and/or other ordnance. The ordnance dispenser segment 402 is easily configurable to accommodate future ordnance. For example, a number of the ordnance dispenser segment 402 may be based on a number and a type of the ordnance desired, and a capacity of a host airframe such as the helicopter 302.

Each ordnance dispenser segment 402 is fully interchangeable so that a mix of 81 mm and 120 mm segments can be attached in a single ordnance dispenser pod 304.

In one embodiment, the segment enclosure 418 comprises a segment door 422 that may be part of the ordnance bay door 308. A plurality of segment door 422 may be arranged to form the ordnance bay door 308 and may be configured to open independent of one another under control of the control module 404. In this document, a segment door 422, a door, and an ordnance bay door may be used interchangeably.

The electronic section segment 404 (control module 404) is configured to target, fuse, and release the ordnance 412. The electronic section segment 404 may comprise a target designator 306, a target acquisition sensor 406, an ordinance bay door motor 408, a ballistic computer 410 comprising hardware and/or software, and other modules and components suitable to release and control the ordnance 412 as explained in more detail in the context of discussion of FIG. 5 below.

Figure 5:
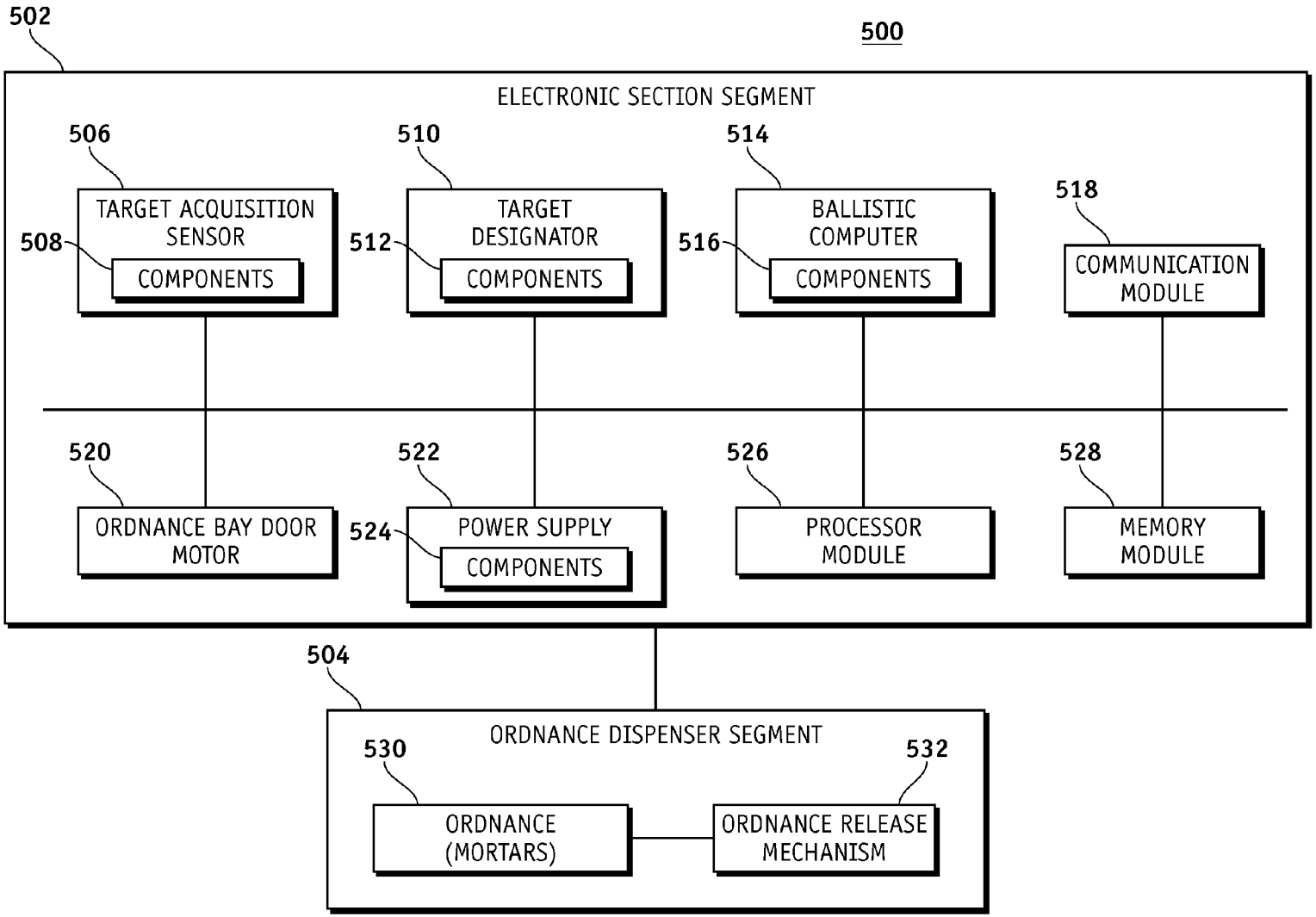
FIG. 5 is an illustration of an exemplary functional block diagram of an attachable/detachable segmented ordnance dispenser system according to an embodiment of the disclosure.

FIG. 5 is an illustration of an exemplary functional block diagram of an attachable/detachable segmented ordnance dispenser system 500 (system 500) according to an embodiment of the disclosure. The system 500 may be used in a roll on/roll off pod such as the ordnance dispenser pod 304 (FIGS. 3-4). The system 500 may have functions, material, and structures that are similar to the embodiments shown in FIGS. 1-4. Therefore common features, functions, and elements may not be redundantly described here.

The various illustrative blocks, modules, processing logic, and circuits described in connection with system 500 may be implemented or performed with a general purpose processor, a content addressable memory, a digital signal processor, an application specific integrated circuit, a field programmable gate array, any suitable programmable logic device, discrete gate or transistor logic, discrete hardware components, or any combination thereof, designed to perform the functions described herein.

A processor may be realized as a microprocessor, a controller, a microcontroller, a state machine, and the like. A processor may also be implemented as a combination of computing devices, e.g., a combination of a digital signal processor and a microprocessor, a plurality of microprocessors, one or more microprocessors in conjunction with a digital signal processor core, or any other such configuration.

In the embodiment shown in FIG. 5, the system 500 comprises an electronic section segment 502 (404 in FIGS. 3-4), and an ordnance dispenser segment 504 (402 in FIG. 4) coupled to the electronic section segment 502.

The electronic section segment 502 may comprise, a target acquisition sensor 506 (406 in FIG. 4), a target designator 510 (306 in FIG. 4), a ballistic computer 514 (410 in FIG. 4), a communication module 518, an ordnance bay door motor 520, a power supply 522, a processor module 526, and a memory module 528.

The target acquisition sensor 506 may be coupled to the rack mount ordnance assembly 414 and may be configured to sense a sensed target. The target acquisition sensor 506 may also comprise target acquisition components 508. The target acquisition sensor 506 may comprise, for example but without limitation, an electronic sensor, an optical sensor, and an infra-red sensor, or other sensor.

The target designator 510 may be coupled to the target acquisition sensor 506 and may be configured to designate the sensed target. The target designator 510 may also comprise target designator components 512. The target designator 510 may comprise, for example but without limitation, a laser sensor, a GPS sensor, or other sensor.

The ballistic computer 514 may be coupled to the target designator 510 and may be configured to compute an ordnance release timing for each of the ordnance 530 according to the sensed target. The ballistic computer 514 may also comprise ballistic computer components 516.

The communication module 518 may be coupled to the ballistic computer 514 and may be configured to receive the ordnance release timing therefrom.

The ordnance bay door motor 520 may be coupled to the ordnance bay door 308 (FIG. 3) and may be configured to open and close the ordnance bay door 308 and/or the segment door 422.

The power supply 522 may be coupled to the ordnance dispenser pod 304 and may be configured to supply power to the system 500. The power supply 522 may comprise power distribution components 524.

The processor module 526 comprises processing logic that is configured to carry out the functions, techniques, and processing tasks associated with the operation of the system 500. In particular, the processing logic is configured to support the system 500 described herein. For example, the processor module 526 may provide data from the memory module 528 to the ballistic computer 514. The data may comprise, for example but without limitation, an airspeed, an altitude, a time of release, or other data.

The processor module 526 also accesses data stored in various databases in the memory module 528, to support functions of the system 500. Thereby, the processor module 526 enables activating the ordnance release mechanism 532 in the ordnance dispenser segment 504 in response to detecting the ordnance release timing from the communication module 518.

The processor module 526 may be implemented, or realized, with a general purpose processor, a content addressable memory, a digital signal processor, an application specific integrated circuit, a field programmable gate array, any suitable programmable logic device, discrete gate or transistor logic, discrete hardware components, or any combination thereof, designed to perform the functions described herein.

In this manner, a processor may be realized as a microprocessor, a controller, a microcontroller, a state machine, or the like. A processor may also be implemented as a combination of computing devices, e.g., a combination of a digital signal processor and a microprocessor, a plurality of microprocessors, one or more microprocessors in conjunction with a digital signal processor core, or any other such configuration.

The memory module 528 may be a data storage area with memory formatted to support the operation of the system 500. The memory module 528 is configured to store, maintain, and provide data as needed to support functionality of the system 500 in the manner described below. In practical embodiments, the memory module 528 may comprise, for example but without limitation, a non-volatile storage device (non-volatile semiconductor memory, hard disk device, optical disk device, and the like), a random access storage device (for example, SRAM, DRAM), or any other form of storage medium known in the art. The memory module 528 may be coupled to the processor module 526 and configured to store the data mentioned above.

Additionally, the memory module 528 may represent a dynamically updating database containing a table for updating various databases. The memory module 528 may also store, the data mentioned above, a computer program that is executed by the processor module 526, an operating system, an application program, tentative data used in executing a program, or other application or data.

The memory module 528 may be coupled to the processor module 526 such that the processor module 526 can read information from and write information to the memory module 528. As an example, the processor module 526 and memory module 528 may reside in respective application specific integrated circuits (ASICs). The memory module 528 may also be integrated into the processor module 526. In an embodiment, the memory module 528 may comprise a cache memory for storing temporary variables or other intermediate information during execution of instructions to be executed by the processor module 526.

Figure 6:
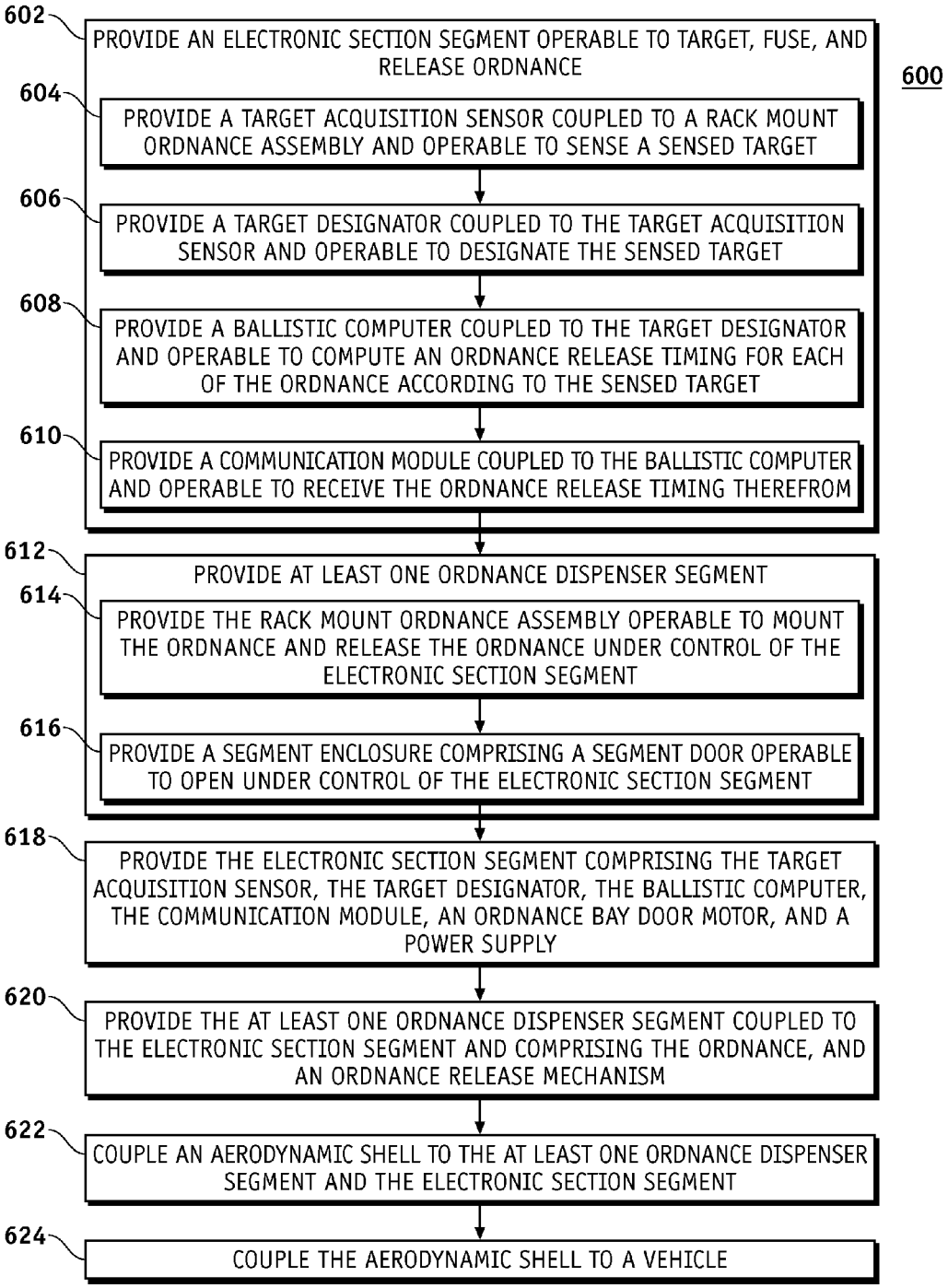
FIG. 6 is an illustration of an exemplary flowchart showing a process for providing an attachable/detachable segmented ordnance dispenser system according to an embodiment of the disclosure.

FIG. 6 is an illustration of an exemplary flowchart showing a process 600 for providing an attachable/detachable segmented ordnance dispenser system according to an embodiment of the disclosure. The various tasks performed in connection with process 600 may be performed mechanically, by software, hardware, firmware, a computer-readable medium having computer executable instructions for performing the process method, or any combination thereof. It should be appreciated that process 600 may include any number of additional or alternative tasks, the tasks shown in FIG. 6 need not be performed in the illustrated order, and process 600 may be incorporated into a more comprehensive procedure or process having additional functionality not described in detail herein.

For illustrative purposes, the following description of process 800 may refer to elements mentioned above in connection with FIGS. 1-5. In practical embodiments, portions of the process 600 may be performed by different elements of the system 500 such as: the electronic section segment 502, and the ordnance dispenser segment 504. Process 600 may have functions, material, and structures that are similar to the embodiments shown in FIGS. 1-5. Therefore common features, functions, and elements may not be redundantly described here.

Process 600 may begin by providing an electronic section segment such as the electronic section segment 502 operable to target, fuse, and release ordnance (task 602).

Process 600 may continue by providing the electronic section segment 502 by providing a target acquisition sensor, providing a target designator, providing a ballistic computer, and providing a communication module as described in tasks 604-610 below.

Process 600 may continue by providing a target acquisition sensor such as the target acquisition sensor 506 coupled to a rack mount ordnance assembly such as the rack mount ordnance assembly 414 and operable to sense a sensed target (task 604).

Process 600 may continue by providing a target designator such as the target designator 510 coupled to the target acquisition sensor 506 and operable to designate the sensed target (task 606).

Process 600 may continue by providing a ballistic computer such as the ballistic computer 514 coupled to the target designator 510 and operable to compute an ordnance release timing for each of the ordnance 412 according to the sensed target (task 608).

Process 600 may continue by providing a communication module such as the communication module 518 coupled to the ballistic computer 514 and operable to receive the ordnance release timing therefrom (task 610).

Process 600 may continue by providing at least one ordnance dispenser segment such as the ordnance dispenser segment 504 (task 612).

Process 600 may continue by providing the ordnance dispenser segment 504 by providing a rack mount ordnance assembly, and providing an segment enclosure as described in tasks 614-616 below.

Process 600 may continue by providing a rack mount ordnance assembly such as the rack mount ordnance assembly 414 operable to mount the ordnance 530 and release the ordnance 530 under control of the electronic section segment 502 (task 614).

Process 600 may continue by providing a segment enclosure such as the segment enclosure 418 comprising a segment door such as the segment door 422 operable to open under control of the electronic section segment 502 (task 616).

Process 600 may continue by providing the electronic section segment 502 comprising the target acquisition sensor 506, the target designator 510, the ballistic computer 514, the communication module 518, an ordnance bay door motor such as the ordnance bay door motor 520, and a power supply such as the power supply 522 (task 618).

Process 600 may continue by providing at least one ordnance dispenser segment 504 coupled to the electronic section segment 502 and comprising ordnance such as the ordnance 530 and an ordnance release mechanism such as the ordnance release mechanism 532 (task 620).

Process 600 may continue by coupling an aerodynamic shell such as the aerodynamic shell 310 to the at least one ordnance dispenser segment 504 and the electronic section segment 502 (task 622).

Process 600 may continue by coupling the aerodynamic shell 310 to a vehicle such as the helicopter 302 (task 624).

In this way, an attachable/detachable ordnance dispenser system is provided to be a force multiplier for small units, a special operations command, and naval forces.

The above description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIGS. 1-6 depict example arrangements of elements, additional intervening elements, devices, features, or components may be present in an embodiment of the disclosure.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "normal," "standard," "known," and terms of similar meaning should not be construed as limiting the item described to a given time period or to an item available as of a given time, but instead should be read to encompass conventional, traditional, normal, or standard technologies that may be available or known now or at any time in the future.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent. The term "about" when referring to a numerical value or range is intended to encompass values resulting from experimental error that can occur when taking measurements.

The invention claimed is:

1. An attachable/detachable segmented ordnance dispenser system comprising:

a control module operable to target, fuse, and release ordnance;

a plurality of ordnance dispenser segments operable to detachably couple to an ordnance dispenser pod and configured to be interchangeable and to allow mixed segments comprising various sizes to be detachably attached in the ordnance dispenser pod, each of the ordnance dispenser segments comprising:

a rack mount ordnance assembly operable to mount the ordnance and release the ordnance under control of the control module; and a segment enclosure comprising a segment door operable to open under control of the control module; and an aerodynamic shell coupled to and operable to aerodynamically enhance and protect the ordnance dispenser segments and the control module, and further operable to be coupled to a vehicle.

2. The system of claim 1, wherein the control module comprises:

a target acquisition sensor coupled the rack mount ordnance assembly and operable to sense a sensed target;

a target designator coupled to the target acquisition sensor and operable to designate the sensed target;

a ballistic computer coupled to the target designator and operable to compute an ordnance release timing for the ordnance according to the sensed target; and a communication module coupled to the ballistic computer and operable to receive the ordnance release timing therefrom.

3. An attachable/detachable segmented ordnance dispenser system, the system comprising:

an ordnance dispenser pod operable to dispense ordnance;

a plurality of ordnance dispenser segments each:

operable to detachably couple to the ordnance dispenser pod, and configured to be interchangeable and to allow mixed segments comprising various sizes to be attached in the ordnance dispenser pod;

a rack mount ordnance assembly coupled to an interior of the ordnance dispenser pod and operable to hold the ordnance;

a target acquisition sensor coupled to the rack mount ordnance assembly and operable to sense a sensed target;

a target designator coupled to the target acquisition sensor and operable to designate the sensed target;

a ballistic computer coupled to the target designator and operable to compute an ordnance release timing for the ordnance according to the sensed target;

a communication module coupled to the ballistic computer and operable to receive the ordnance release timing therefrom; and an ordnance release mechanism operable to receive the ordnance release timing from the communication module and release the ordnance according to and based on the ordnance release timing.

4. The system of claim 3, further comprising:

an ordnance bay door coupled to the ordnance dispenser pod;

an ordnance bay door motor operable to open and close the ordnance bay door;

target acquisition components coupled to the target acquisition sensor;

target designator components coupled to the target designator;

ballistic computer components coupled to the ballistic computer;

a power supply operable to supply power to the attachable/detachable segmented ordnance dispenser system; and power distribution components coupled to the power supply.

5. The system of claim 4, wherein the attachable/detachable segmented ordnance dispenser system comprises an electronic section segment comprising the target acquisition sensor, the target designator, the ballistic computer, the communication module, the ordnance bay door motor, and the power supply.

6. The system of claim 5, wherein each of the ordnance dispenser segments is coupled to the electronic section segment and comprises the ordnance and the ordnance release mechanism.

7. The system of claim 3, wherein the ordnance comprises at least one member selected from the group consisting of: mortars, bombs, missiles, rockets, gun ammunition, air-to-air weapons, anti-ship weapons, and anti-submarine weapons.

8. The system of claim 3, wherein the mixed segments comprise an 81 mm guided mortar, and a 120 mm guided mortar in their respective separate segments.

9. The system of claim 3, wherein the attachable/detachable segmented ordnance dispenser system is attached to a vehicle.

10. The system of claim 9, wherein the vehicle comprises an aircraft.

11. The system of claim 3, wherein the target acquisition sensor comprises at least one of: an electronic sensor, an optical sensor, and an infra-red sensor.

12. A method for providing an attachable/detachable segmented ordnance dispenser system comprising:

providing an electronic section segment operable to target, fuse, and release ordnance;

providing a plurality of ordnance dispenser segments by:

configuring the ordnance dispenser segments to be interchangeable and to allow mixed segments comprising various sizes to be detachably attached in an ordnance dispenser pod;

providing a rack mount ordnance assembly for each of the ordnance dispenser segments operable to mount the ordnance and release the ordnance under control of the electronic section segment; and providing a segment enclosure comprising a segment door operable to open under control of the electronic section segment;

detachably coupling each of the ordnance dispenser segments to the ordnance dispenser pod; and coupling an aerodynamic shell to the ordnance dispenser segments and the electronic section segment.

13. The method of claim 12, further comprising coupling the aerodynamic shell to an aircraft.

14. The method of claim 12, further comprising providing the electronic section segment by:

providing a target acquisition sensor coupled to the rack mount ordnance assembly and operable to sense a sensed target;

providing a target designator coupled to the target acquisition sensor and operable to designate the sensed target;

providing a ballistic computer coupled to the target designator and operable to compute an ordnance release timing for the ordnance according to the sensed target; and providing a communication module coupled to the ballistic computer and operable to receive the ordnance release timing therefrom.

15. The method of claim 14, further comprising providing the electronic section segment comprising the target acquisition sensor, the target designator, the ballistic computer, the communication module, an ordnance bay door motor, and a power supply.

16. The method of claim 15, further comprising providing at least one ordnance dispenser segment coupled to the electronic section segment and comprising the ordnance and an ordnance release mechanism.

17. The system of claim 1, wherein the mixed segments comprise an 81 mm guided mortar, and a 120 mm guided mortar in their respective separate segments.

18. The system of claim 1, wherein a number of the ordnance dispenser segments is based on a number and a type of an ordnance desired, and a capacity of a host airframe.

19. The method of claim 12, wherein the mixed segments comprise an 81 mm guided mortar, and a 120 mm guided mortar in their respective separate segments.

20. The method of claim 12, further comprising configuring a number of the ordnance dispenser segments based on a number and a type of an ordnance desired, and a capacity of a host airframe.

* * * * *